US010440995B2

(12) United States Patent
Sebastian et al.

(10) Patent No.: US 10,440,995 B2
(45) Date of Patent: Oct. 15, 2019

(54) AEROSOL DELIVERY DEVICE INCLUDING SUBSTRATE WITH IMPROVED ABSORBENCY PROPERTIES

(71) Applicant: RAI Strategic Holdings, Inc., Winston-Salem, NC (US)

(72) Inventors: Andries Don Sebastian, Clemmons, NC (US); Michael F. Davis, Clemmons, NC (US); Percy D. Phillips, Pfafftown, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 0 days.

(21) Appl. No.: 15/472,966

(22) Filed: Mar. 29, 2017

(65) Prior Publication Data

US 2018/0279673 A1 Oct. 4, 2018

(51) Int. Cl.

| | |
|---|---|
| ***A24F 11/00*** | (2006.01) |
| ***A24F 47/00*** | (2006.01) |
| ***A24F 13/00*** | (2006.01) |
| ***A24F 17/00*** | (2006.01) |
| ***A24F 25/00*** | (2006.01) |
| ***H05B 1/02*** | (2006.01) |

(52) U.S. Cl.
CPC ..... *A24F 47/008* (2013.01); *H05B 1/0244* (2013.01); *H05B 2203/021* (2013.01)

(58) Field of Classification Search
CPC ..... A24F 47/008; A61M 15/00
USPC ..... 131/328, 329
See application file for complete search history.

(56) References Cited

U.S. PATENT DOCUMENTS

| | | | |
|---|---|---|---|
| 2,057,353 | A | 10/1936 | Whittemore, Jr. |
| 2,104,266 | A | 1/1938 | McCormick |
| 3,200,819 | A | 8/1965 | Gilbert |
| 4,922,901 | A | 5/1990 | Brooks et al. |
| 5,060,671 | A | 10/1991 | Counts et al. |
| 5,093,894 | A | 3/1992 | Deevi et al. |
| 5,261,424 | A | 11/1993 | Sprinkel, Jr. |
| 5,388,574 | A | 2/1995 | Ingebrethsen et al. |
| 5,530,225 | A | 6/1996 | Hajaligol |
| 5,687,746 | A | 11/1997 | Rose et al. |
| 5,726,421 | A | 3/1998 | Fleischhauer et al. |
| 5,865,185 | A | 2/1999 | Collins et al. |
| 5,894,841 | A | 4/1999 | Voges |
| 6,125,853 | A | 10/2000 | Susa et al. |

(Continued)

FOREIGN PATENT DOCUMENTS

| | | |
|---|---|---|
| CN | 1541577 | 11/2004 |
| CN | 2719043 | 8/2005 |

(Continued)

*Primary Examiner* — Abdullah A Riyami
*Assistant Examiner* — Thang H Nguyen
(74) *Attorney, Agent, or Firm* — Womble Bond Dickinson (US) LLP

(57) ABSTRACT

The present disclosure relates to aerosol delivery devices, methods of forming such devices, and elements of such devices. In some embodiments, the present disclosure provides substrates for use in storing an aerosol precursor liquid and/or transporting the liquid to a heater for vaporization. The substrates can be formed form fibers that can provide improved absorbency and/or transport qualities. Multi-layer substrates are also disclosed and can include a high absorbency layer and a hydrophobic layer.

15 Claims, 9 Drawing Sheets

(56) References Cited

U.S. PATENT DOCUMENTS

| | | | | |
|---|---|---|---|---|
| 6,155,268 | A | 12/2000 | Takeuchi | |
| 7,117,867 | B2 | 10/2006 | Cox et al. | |
| 7,832,410 | B2 | 11/2010 | Hon | |
| 8,314,591 | B2 | 11/2012 | Terry et al. | |
| 8,365,742 | B2 | 2/2013 | Hon | |
| 8,499,766 | B1 | 8/2013 | Newton | |
| 2005/0016550 | A1 | 1/2005 | Katase | |
| 2006/0196518 | A1 | 9/2006 | Hon | |
| 2008/0092912 | A1 | 4/2008 | Robinson et al. | |
| 2009/0095311 | A1 | 4/2009 | Hon | |
| 2009/0126745 | A1 | 5/2009 | Hon | |
| 2009/0188490 | A1 | 7/2009 | Hon | |
| 2009/0272379 | A1 | 11/2009 | Thorens et al. | |
| 2011/0094523 | A1 | 4/2011 | Thorens et al. | |
| 2011/0126848 | A1 | 6/2011 | Zuber et al. | |
| 2011/0155718 | A1 | 6/2011 | Greim et al. | |
| 2011/0168194 | A1 | 7/2011 | Hon | |
| 2011/0265806 | A1 | 11/2011 | Alarcon et al. | |
| 2011/0290248 | A1 | 12/2011 | Schennum | |
| 2012/0111347 | A1 | 5/2012 | Hon | |
| 2012/0260927 | A1 | 10/2012 | Liu | |
| 2012/0279512 | A1 | 11/2012 | Hon | |
| 2013/0037041 | A1* | 2/2013 | Worm | A24F 47/008 131/329 |
| 2013/0056013 | A1 | 3/2013 | Terry et al. | |
| 2013/0306084 | A1 | 11/2013 | Flick | |
| 2014/0000638 | A1 | 1/2014 | Sebastian et al. | |
| 2014/0060554 | A1 | 3/2014 | Collett et al. | |
| 2014/0060555 | A1 | 3/2014 | Chang et al. | |
| 2014/0096781 | A1 | 4/2014 | Sears et al. | |
| 2014/0096782 | A1 | 4/2014 | Ampolini et al. | |
| 2014/0209105 | A1 | 7/2014 | Sears et al. | |
| 2014/0238424 | A1* | 8/2014 | Macko | A24F 47/008 131/328 |
| 2014/0253144 | A1 | 9/2014 | Novak et al. | |
| 2014/0261408 | A1 | 9/2014 | DePiano et al. | |
| 2014/0261486 | A1 | 9/2014 | Potter et al. | |
| 2014/0261487 | A1 | 9/2014 | Chapman et al. | |
| 2014/0261495 | A1 | 9/2014 | Novak et al. | |
| 2014/0270727 | A1* | 9/2014 | Ampolini | A24F 47/008 392/387 |
| 2014/0270729 | A1 | 9/2014 | DePiano et al. | |
| 2014/0270730 | A1 | 9/2014 | DePiano et al. | |
| 2014/0299143 | A1* | 10/2014 | Bundren | B29C 48/30 131/332 |
| 2015/0144145 | A1* | 5/2015 | Chang | A24F 47/008 131/328 |
| 2015/0189913 | A1* | 7/2015 | Binassi | A24D 3/068 131/332 |
| 2015/0374030 | A1* | 12/2015 | Lisauskas | A24D 3/0229 131/345 |
| 2016/0073689 | A1* | 3/2016 | Sebastian | A24B 13/00 131/352 |
| 2016/0135506 | A1* | 5/2016 | Sanchez | A24F 47/008 131/329 |
| 2016/0157515 | A1* | 6/2016 | Chapman | A24B 13/00 131/352 |
| 2016/0192703 | A1* | 7/2016 | Sebastian | A24F 23/02 131/352 |
| 2016/0262454 | A1* | 9/2016 | Sears | A24F 47/008 |
| 2018/0325174 | A1* | 11/2018 | Sutton | A24B 9/00 |

FOREIGN PATENT DOCUMENTS

| | | |
|---|---|---|
| CN | 201379072 | 1/2010 |
| EP | 0 295 122 | 12/1988 |
| EP | 0 845 220 | 6/1998 |
| EP | 1 618 803 | 1/2006 |
| GB | 2469850 | 11/2010 |
| WO | WO 2003/034847 | 5/2003 |
| WO | WO 2004/080216 | 9/2004 |
| WO | WO 2005/099494 | 10/2005 |
| WO | WO 2007/131449 | 11/2007 |
| WO | WO 2015/108816 | 7/2015 |

* cited by examiner

AEROSOL DELIVERY DEVICE INCLUDING SUBSTRATE WITH IMPROVED ABSORBENCY PROPERTIES

FIELD OF THE DISCLOSURE

The present disclosure relates to aerosol delivery devices such as smoking articles, and more particularly to aerosol delivery devices that may utilize electrically generated heat for the production of aerosol (e.g., smoking articles commonly referred to as electronic cigarettes). The smoking articles may be configured to heat an aerosol precursor, which may incorporate materials that may be made or derived from tobacco or otherwise incorporate tobacco, the precursor being capable of forming an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices, and heat generating sources set forth in the background art described in U.S. Pat. No. 7,726,320 to Robinson et al., U.S. Pat. Pub. No. 2013/0255702 to Griffith Jr. et al., and U.S. Pat. Pub. No. 2014/0096781 to Sears et al., which are incorporated herein by reference. See also, for example, the various types of smoking articles, aerosol delivery devices, and electrically powered heat generating sources referenced by brand name and commercial source in U.S. Pat. Pub. No. 2015/0216232 to Bless et al., which is incorporated herein by reference in its entirety.

It would be desirable to provide a reservoir for an aerosol precursor composition for use in an aerosol delivery device, the reservoir being provided so as to improve formation of the aerosol delivery device. It would also be desirable to provide aerosol delivery devices that are prepared utilizing such reservoirs.

SUMMARY OF THE DISCLOSURE

The present disclosure relates to aerosol delivery devices, methods of forming such devices, and elements of such devices. The aerosol delivery devices can provide for improved storage and/or transport of an aerosol precursor composition. In particular, a substrate as described herein can be formed form fibers such that the substrate exhibits surprisingly increased storage capacity for the aerosol precursor composition.

In one or more embodiments, an aerosol delivery device as disclosed herein can comprise: a housing; a substrate at least partially formed from regenerated cellulose fibers; an aerosol forming liquid retained by the substrate; and a heater operatively arranged for vaporization of the aerosol forming liquid. Preferably, the regenerated cellulose fibers include one or more of: regenerated cellulose fibers having a hollow, substantially cylindrical cross-section; regenerated cellulose fibers having a multi-lobal cross-section; regenerated cellulose fibers that include a hydrophobic additive. In further embodiments, the aerosol delivery device may be further defined in relation to one or more of the following statements, which may be combined in any number and order.

The regenerated cellulose fibers can have a multi-lobal cross-section and include striations extending longitudinally along surfaces of one or more lobes of the fibers.

The substrate can be a non-woven.

The substrate can comprise a plurality of layers.

A single layer of the substrate and/or a plurality of layers in combination forming the substrate can be needle-punched.

A plurality of layers in combination forming the substrate can be adhered together.

The substrate can comprise a first layer comprising one or both of the regenerated cellulose fibers having a hollow, substantially cylindrical cross-section and the regenerated cellulose fibers having a multi-lobal cross-section, and the substrate can comprise a second layer comprising the regenerated cellulose fibers that include a hydrophobic additive.

A first layer of the substrate can be configured for storage and release of the aerosol precursor composition, and a second layer of the substrate can be hydrophobic.

The substrate can form at least a portion of a reservoir.

The aerosol delivery device can further comprise a liquid transport element in fluid connection with the reservoir and in fluid connection with the heater.

The substrate can form at least part of a liquid transport element that is in fluid connection with a reservoir and in fluid connection with the heater.

The substrate can be in direct contact with the heater.

The substrate can have a loading capacity for the aerosol precursor composition of at least 2000% relative to an initial dry weight of the substrate.

The substrate can have a basis weight of about 100 gsm to about 250 gsm.

The aerosol delivery device can further comprise a power source and a controller.

In one or more embodiments, the present disclosure further can provide a method for preparing an aerosol delivery device. For example, such method can comprise:

providing a housing;

placing within the housing a substrate at least partially formed from regenerated cellulose fibers including one or more of: regenerated cellulose fibers having a hollow, substantially cylindrical cross-section; regenerated cellulose fibers having a multi-lobal cross-section; regenerated cellulose fibers that include a hydrophobic additive; and configuring the substrate to be in fluid communication with a heater within the housing;

wherein, before or after placing the substrate within the housing, an aerosol forming liquid is retained by the substrate. In further embodiments, the method may be defined by one or both of the following statements.

The method can further comprise combining a mouthpiece with the housing.

The method can further comprise combining the housing with a second housing that includes a battery and a controller.

BRIEF DESCRIPTION OF THE FIGURES

Figure 1:
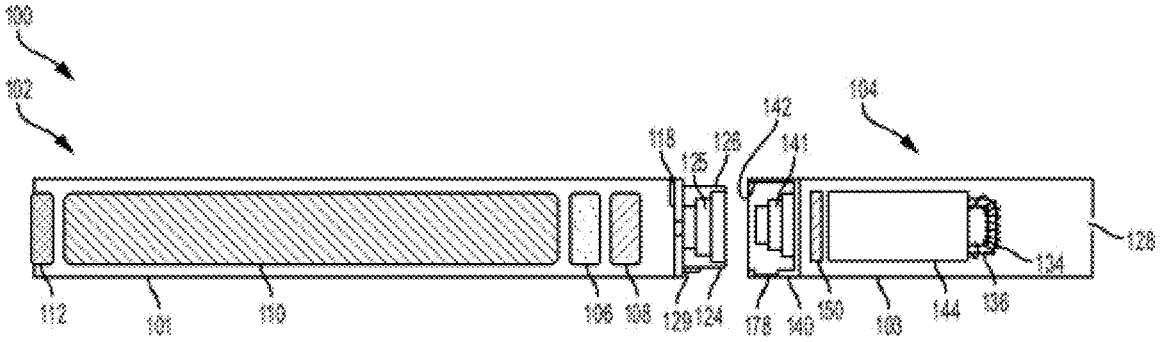
Figure 2:
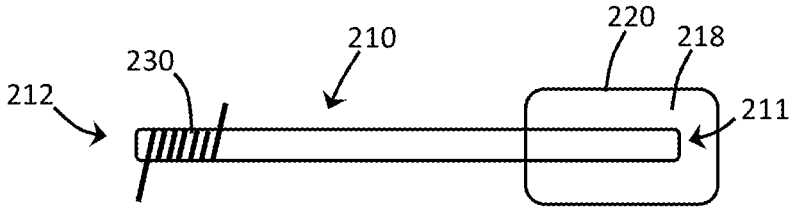
Figure 3:
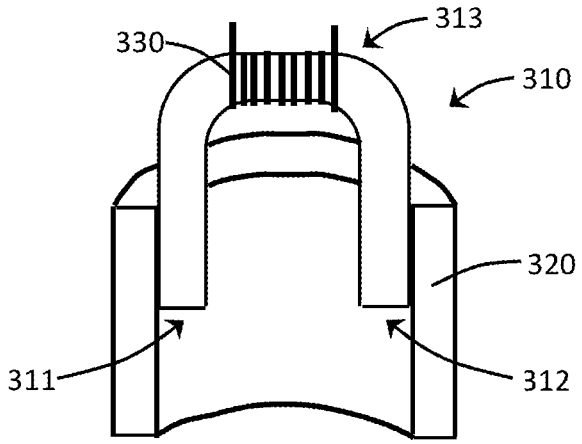
Figure 4:
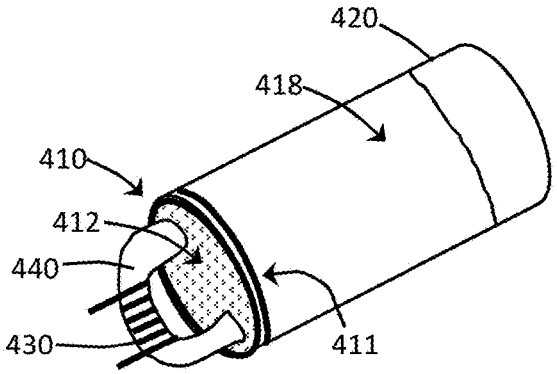
Figure 5A:
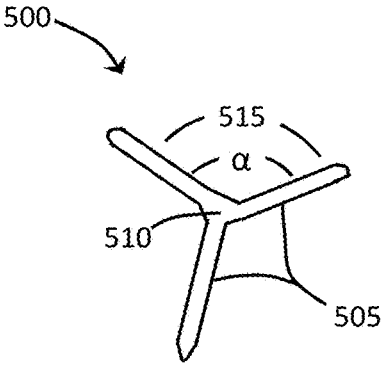
Figure 5B:
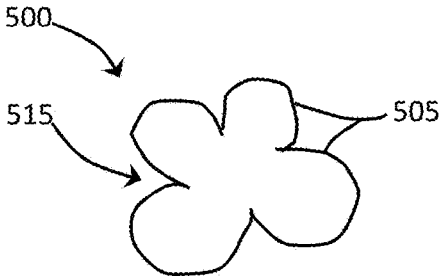
Figure 5C:
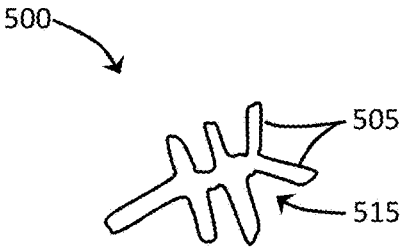
Figure 5D:
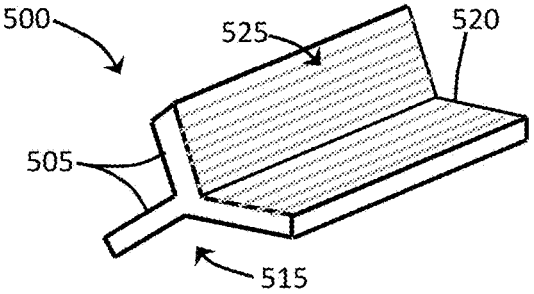
Figure 6:
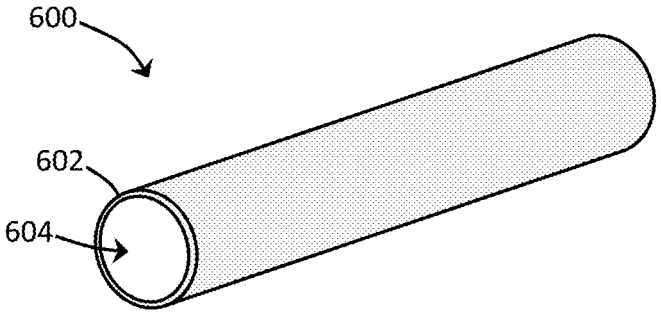
Figure 7:
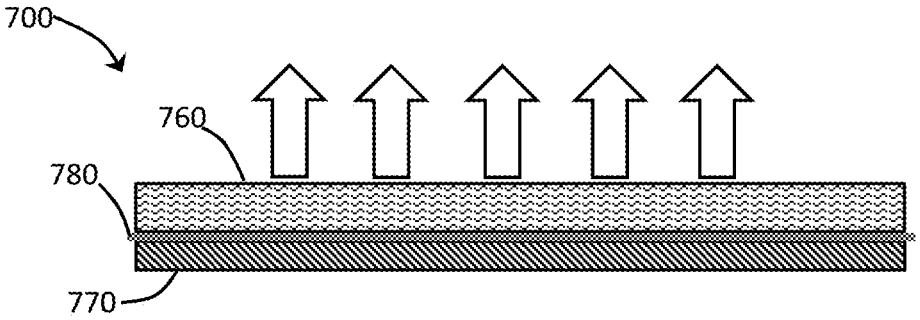
Figure 8:
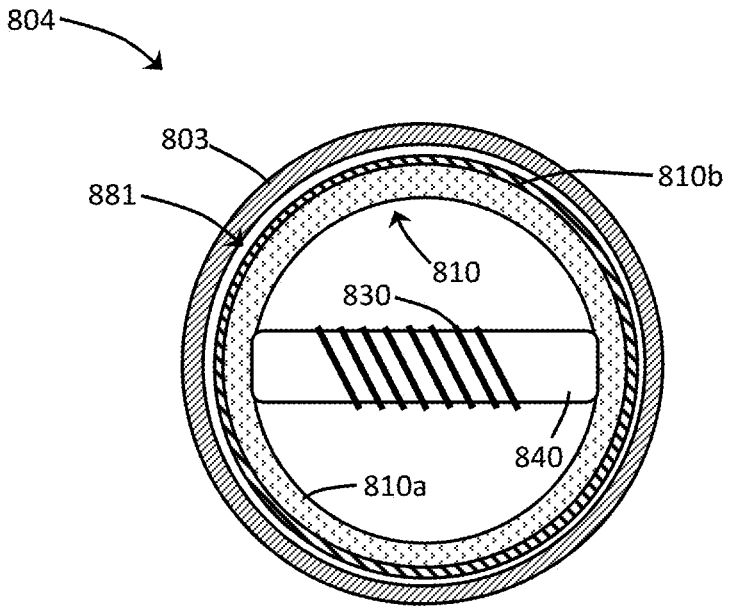
Figure 9:
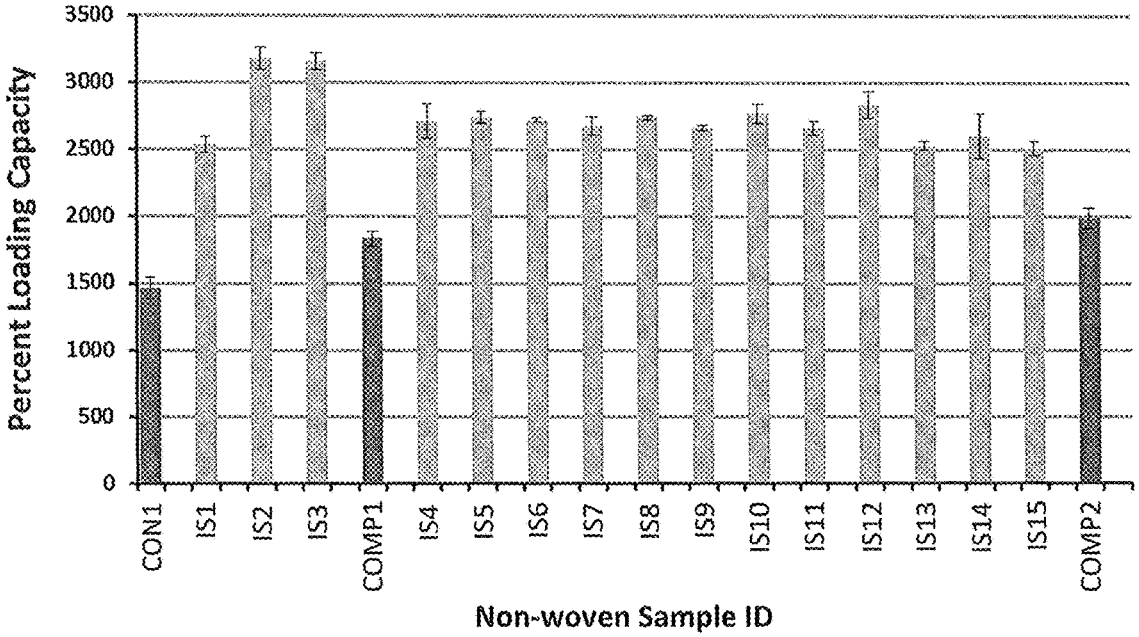
Figure 10:
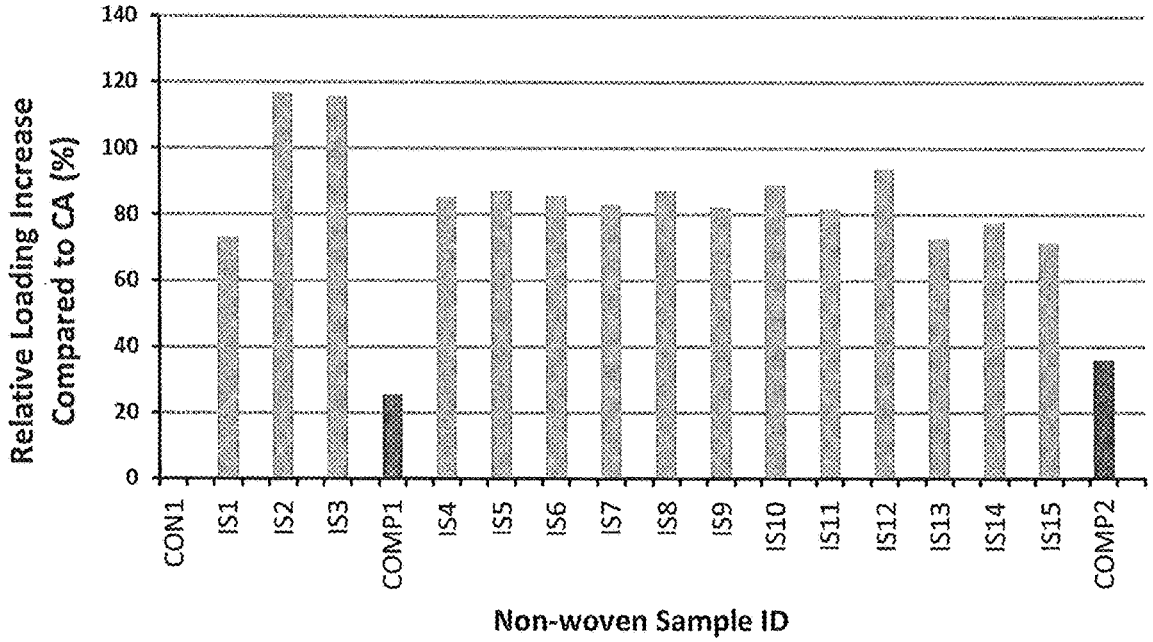
Figure 11:
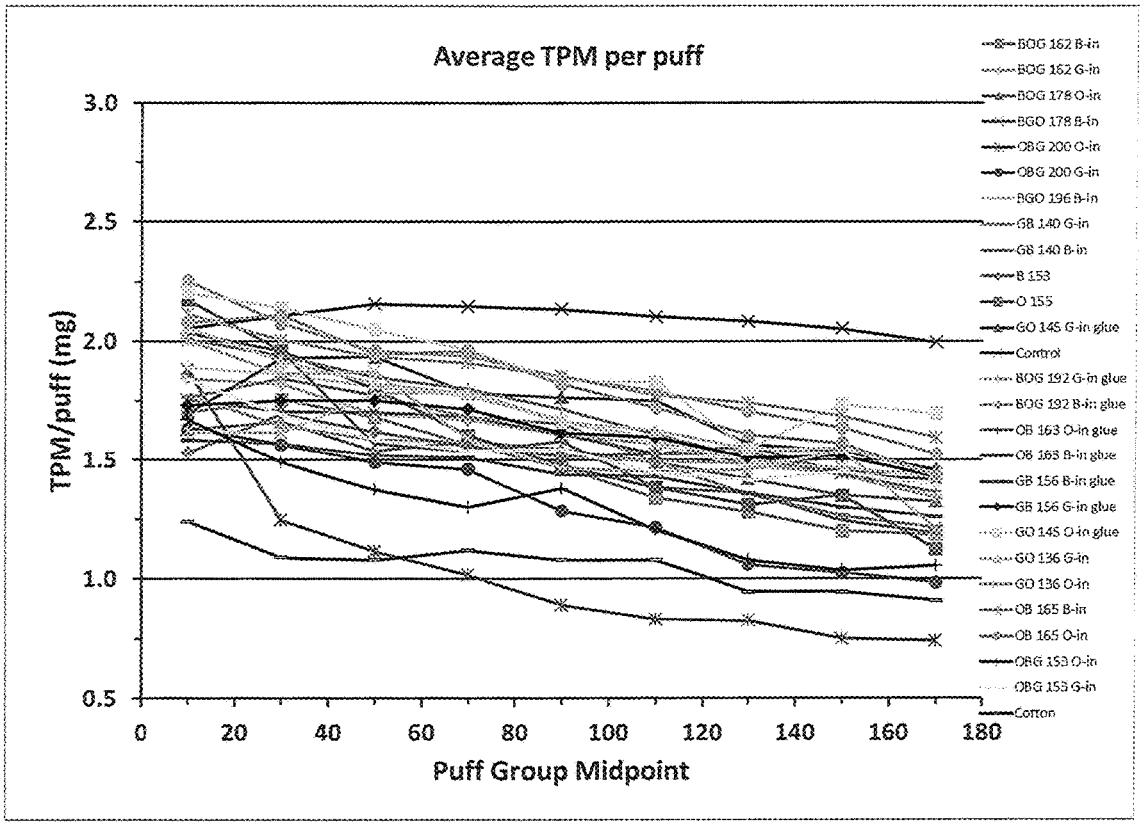
Figure 12:
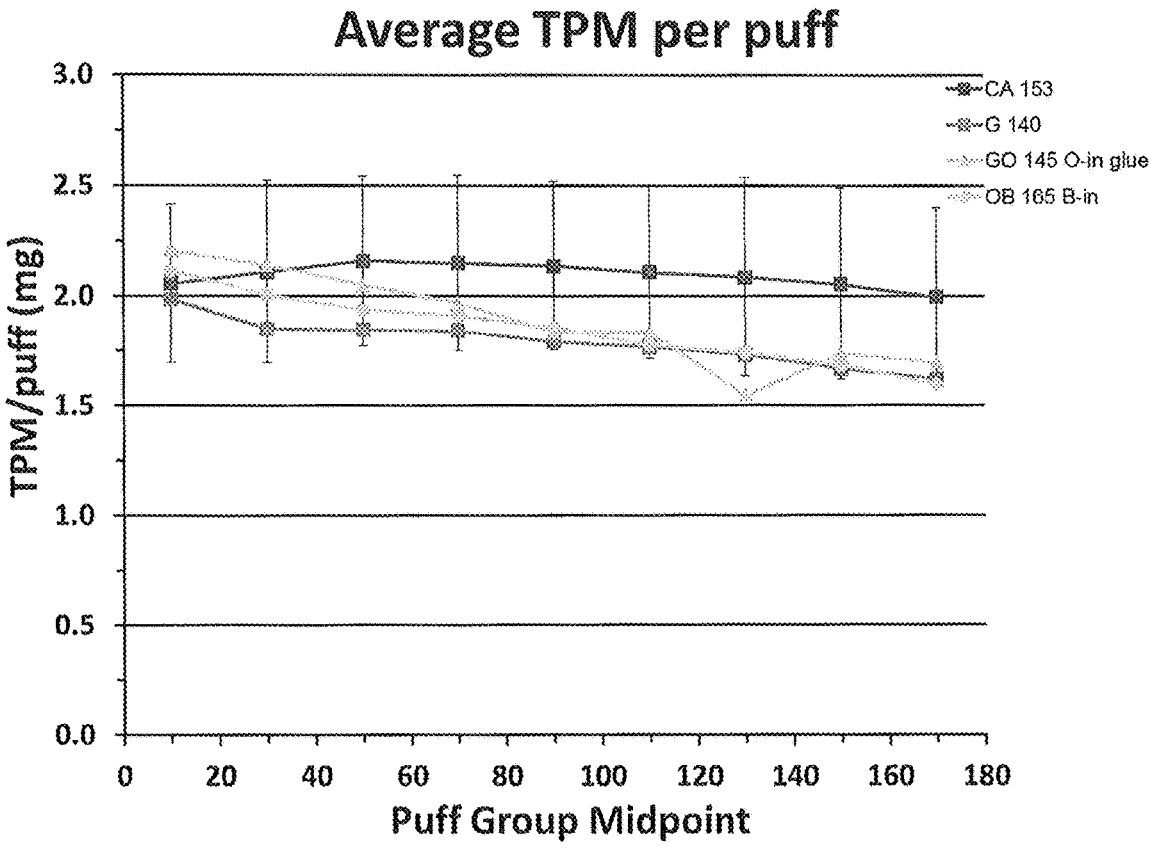

Having thus described the disclosure in the foregoing general terms, reference will now be made to the accompanying drawings, which are not necessarily drawn to scale, and wherein:

FIG. 1 is a partially cut-away view of an aerosol delivery device comprising a cartridge and a control body including a variety of elements that may be utilized in an aerosol delivery device according to various embodiments of the present disclosure;

FIG. 2 is an illustration of a substrate according to embodiments of the present disclosure in combination with a separate reservoir and heater, the substrate thus functioning as a liquid transport element;

FIG. 3 is a partially cut-away illustration of a substrate according to embodiments of the present disclosure in combination with a separate reservoir and heater, the substrate thus functioning as a liquid transport element;

FIG. 4 is an illustration of a substrate according to embodiments of the present disclosure functioning as an intermediate liquid transport element through combination with a reservoir and a separate wick and heater;

FIG. 5A is a cross-sectional illustration of a multi-lobed fiber according to embodiments of the present disclosure, the fiber particularly being tri-lobal;

FIG. 5B is a cross-sectional illustration of a multi-lobed fiber with four lobes according to embodiments of the present disclosure;

FIG. 5C is a cross-sectional illustration of a multi-lobed fiber with seven lobes according to embodiments of the present disclosure;

FIG. 5D is an illustration of a tri-lobal fiber according to embodiments of the present disclosure, the individual lobes includes faces (or surfaces) having striations configured longitudinally thereon;

FIG. 6 is an illustration of a hollow fiber according to embodiments of the present disclosure;

FIG. 7 is an illustration of a substrate according to the present disclosure being formed of a plurality of layers and being configured for movement of liquid therefrom substantially from only one face (or surface) of the substrate;

FIG. 8 is a partial cross-sectional illustration of a cartridge according to embodiments of the present disclosure including a multi-layer substrate;

FIG. 9 is a chart showing the percent loading capacity of various substrates according to the present disclosure in relation to a control sample and two comparative samples;

FIG. 10 is a chart showing the relative loading increase of substrates according to the present disclosure compared to a control sample;

FIG. 11 is a chart showing the total particulate matter per puff in an aerosol delivery device having a reservoir formed from substrates according to the present disclosure; and FIG. 12 is a chart showing the total particulate matter per puff in an aerosol delivery device having a reservoir formed from substrates according to the present disclosure.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

As described hereinafter, embodiments of the present disclosure relate to aerosol delivery systems. Aerosol delivery systems according to the present disclosure use electrical energy to heat a material (preferably without combusting the material to any significant degree and/or without significant chemical alteration of the material) to form an inhalable substance; and components of such systems have the form of articles that most preferably are sufficiently compact to be considered hand-held devices. That is, use of components of preferred aerosol delivery systems does not result in the production of smoke—i.e., from by-products of combustion or pyrolysis of tobacco, but rather, use of those preferred systems results in the production of vapors resulting from volatilization or vaporization of certain components incorporated therein. In preferred embodiments, components of aerosol delivery systems may be characterized as electronic cigarettes, and those electronic cigarettes most preferably incorporate tobacco and/or components derived from tobacco, and hence deliver tobacco derived components in aerosol form.

Aerosol generating pieces of certain preferred aerosol delivery systems may provide many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe that is employed by lighting and burning tobacco (and hence inhaling tobacco smoke), without any substantial degree of combustion of any component thereof. For example, the user of an aerosol generating piece of the present disclosure can hold and use that piece much like a smoker employs a traditional type of smoking article, draw on one end of that piece for inhalation of aerosol produced by that piece, take or draw puffs at selected intervals of time, and the like.

Aerosol delivery devices of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like.

Aerosol delivery devices of the present disclosure generally include a number of components provided within an outer body or shell, which may be referred to as a housing. The overall design of the outer body or shell can vary, and the format or configuration of the outer body that can define the overall size and shape of the aerosol delivery device can vary. Typically, an elongated body resembling the shape of a cigarette or cigar can be a formed from a single, unitary housing, or the elongated housing can be formed of two or more separable bodies. For example, an aerosol delivery device can comprise an elongated shell or body that can be substantially tubular in shape and, as such, resemble the shape of a conventional cigarette or cigar. In one embodiment, all of the components of the aerosol delivery device are contained within one housing. Alternatively, an aerosol delivery device can comprise two or more housings that are joined and are separable. For example, an aerosol delivery device can possess at one end a control body comprising a housing containing one or more components (e.g., a battery and various electronics for controlling the operation of that article), and at the other end and removably attached thereto an outer body or shell containing aerosol forming components (e.g., one or more aerosol precursor components, such as flavors and aerosol formers, one or more heaters, and/or one or more wicks).

Aerosol delivery devices of the present disclosure can be formed of an outer housing or shell that is not substantially tubular in shape but may be formed to substantially greater dimensions. The housing or shell can be configured to include a mouthpiece and/or may be configured to receive a separate shell (e.g., a cartridge or tank) that can include consumable elements, such as a liquid aerosol former, and can include a vaporizer or atomizer.

Aerosol delivery devices of the present disclosure most preferably comprise some combination of a power source (i.e., an electrical power source), at least one control component (e.g., means for actuating, controlling, regulating and ceasing power for heat generation, such as by controlling electrical current flow the power source to other components of the article—e.g., a microcontroller or microprocessor), a heater or heat generation member (e.g., an electrical resistance heating element or other component, which alone or in combination with one or more further elements may be commonly referred to as an "atomizer"), an aerosol precursor composition (e.g., commonly a liquid capable of yielding an aerosol upon application of sufficient heat, such as ingredients commonly referred to as "smoke juice," "e-liquid" and "e-juice"), and a mouthpiece or mouth region for allowing draw upon the aerosol delivery device for aerosol inhalation (e.g., a defined airflow path through the article such that aerosol generated can be withdrawn therefrom upon draw).

More specific formats, configurations and arrangements of components within the aerosol delivery systems of the present disclosure will be evident in light of the further disclosure provided hereinafter. Additionally, the selection and arrangement of various aerosol delivery system components can be appreciated upon consideration of the commercially available electronic aerosol delivery devices, such as those representative products referenced in the background art section of the present disclosure.

One example embodiment of an aerosol delivery device 100 illustrating components that may be utilized in an aerosol delivery device according to the present disclosure is provided in FIG. 1. As seen in the cut-away view illustrated therein, the aerosol delivery device 100 can comprise a control body 102 and a cartridge 104 that can be permanently or detachably aligned in a functioning relationship. Engagement of the control body 102 and the cartridge 104 can be press fit (as illustrated), threaded, interference fit, magnetic, or the like. In particular, connection components, such as further described herein may be used. For example, the control body may include a coupler that is adapted to engage a connector on the cartridge.

In specific embodiments, one or both of the control body 102 and the cartridge 104 may be referred to as being disposable or as being reusable. For example, the control body may have a replaceable battery or a rechargeable battery and thus may be combined with any type of recharging technology, including connection to a typical electrical outlet, connection to a car charger (i.e., cigarette lighter receptacle), and connection to a computer, such as through a universal serial bus (USB) cable. For example, an adaptor including a USB connector at one end and a control body connector at an opposing end is disclosed in U.S. Pat. Pub. No. 2014/0261495 to Novak et al., which is incorporated herein by reference in its entirety. Further, in some embodiments the cartridge may comprise a single-use cartridge, as disclosed in U.S. Pat. No. 8,910,639 to Chang et al., which is incorporated herein by reference in its entirety.

As illustrated in FIG. 1, a control body 102 can be formed of a control body shell 101 that can include a control component 106 (e.g., a printed circuit board (PCB), an integrated circuit, a memory component, a microcontroller, or the like), a flow sensor 108, a battery 110, and an LED 112, and such components can be variably aligned. Further indicators (e.g., a haptic feedback component, an audio feedback component, or the like) can be included in addition to or as an alternative to the LED. Additional representative types of components that yield visual cues or indicators, such as light emitting diode (LED) components, and the configurations and uses thereof, are described in U.S. Pat. No. 5,154,192 to Sprinkel et al.; U.S. Pat. No. 8,499,766 to Newton and U.S. Pat. No. 8,539,959 to Scatterday; U.S. Pat. Pub. No. 2015/0020825 to Galloway et al.; and U.S. Pat. Pub. No. 2015/0216233 to Sears et al.; which are incorporated herein by reference.

A cartridge 104 can be formed of a cartridge shell 103 enclosing the reservoir 144 that is in fluid communication with a liquid transport element 136 adapted to wick or otherwise transport an aerosol precursor composition stored in the reservoir housing to a heater 134. A liquid transport element can be formed of one or more materials configured for transport of a liquid, such as by capillary action. A liquid transport element can be formed of, for example, fibrous materials (e.g., organic cotton, cellulose acetate, regenerated cellulose fabrics, glass fibers), porous ceramics, porous carbon, graphite, porous glass, sintered glass beads, sintered ceramic beads, capillary tubes, or the like. The liquid transport element thus can be any material that contains an open pore network (i.e., a plurality of pores that are interconnected so that fluid may flow from one pore to another in a plurality of direction through the element). Various embodiments of materials configured to produce heat when electrical current is applied therethrough may be employed to form the resistive heating element 134. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,Al)_2$), titanium, platinum, silver, palladium, graphite and graphite-based materials (e.g., carbon-based foams and yarns) and ceramics (e.g., positive or negative temperature coefficient ceramics).

An opening 128 may be present in the cartridge shell 103 (e.g., at the mouthend) to allow for egress of formed aerosol from the cartridge 104. Such components are representative of the components that may be present in a cartridge and are not intended to limit the scope of cartridge components that are encompassed by the present disclosure.

The cartridge 104 also may include one or more electronic components 150, which may include an integrated circuit, a memory component, a sensor, or the like. The electronic component 150 may be adapted to communicate with the control component 106 and/or with an external device by wired or wireless means. The electronic component 150 may be positioned anywhere within the cartridge 104 or its base 140.

Although the control component 106 and the flow sensor 108 are illustrated separately, it is understood that the control component and the flow sensor may be combined as an electronic circuit board with the air flow sensor attached directly thereto. Further, the electronic circuit board may be positioned horizontally relative the illustration of FIG. 1 in that the electronic circuit board can be lengthwise parallel to the central axis of the control body. In some embodiments, the air flow sensor may comprise its own circuit board or other base element to which it can be attached. In some embodiments, a flexible circuit board may be utilized. A flexible circuit board may be configured into a variety of shapes, include substantially tubular shapes.

The control body 102 and the cartridge 104 may include components adapted to facilitate a fluid engagement therebetween. As illustrated in FIG. 1, the control body 102 can include a coupler 124 having a cavity 125 therein. The cartridge 104 can include a base 140 adapted to engage the coupler 124 and can include a projection 141 adapted to fit within the cavity 125. Such engagement can facilitate a stable connection between the control body 102 and the cartridge 104 as well as establish an electrical connection between the battery 110 and control component 106 in the control body and the heater 134 in the cartridge. Further, the control body shell 101 can include an air intake 118, which may be a notch in the shell where it connects to the coupler 124 that allows for passage of ambient air around the coupler and into the shell where it then passes through the cavity 125 of the coupler and into the cartridge through the projection 141.

A coupler and a base useful according to the present disclosure are described in U.S. Pat. Pub. No. 2014/0261495 to Novak et al., the disclosure of which is incorporated herein by reference in its entirety. For example, a coupler as seen in FIG. 1 may define an outer periphery 126 configured to mate with an inner periphery 142 of the base 140. In one embodiment the inner periphery of the base may define a radius that is substantially equal to, or slightly greater than, a radius of the outer periphery of the coupler. Further, the coupler 124 may define one or more protrusions 129 at the outer periphery 126 configured to engage one or more recesses 178 defined at the inner periphery of the base. However, various other embodiments of structures, shapes, and components may be employed to couple the base to the coupler. In some embodiments the connection between the base 140 of the cartridge 104 and the coupler 124 of the control body 102 may be substantially permanent, whereas in other embodiments the connection therebetween may be releasable such that, for example, the control body may be reused with one or more additional cartridges that may be disposable and/or refillable.

The aerosol delivery device 100 may be substantially rod-like or substantially tubular shaped or substantially cylindrically shaped in some embodiments. In other embodiments, further shapes and dimensions are encompassed—e.g., a rectangular or triangular cross-section, multifaceted shapes, or the like. In particular, the control body 102 may be non-rod-like and may rather be substantially rectangular, round, or have some further shape. Likewise, the control body 102 may be substantially larger than a control body that would be expected to be substantially the size of a conventional cigarette.

The reservoir 144 illustrated in FIG. 1 can be a container (e.g., formed of walls substantially impermeable to the aerosol precursor composition) or can be a fibrous reservoir. For example, the reservoir 144 can comprise one or more layers of nonwoven fibers substantially formed into the shape of a tube encircling the interior of the cartridge shell 103, in this embodiment. An aerosol precursor composition can be retained in the reservoir 144. Liquid components, for example, can be sorptively retained by the reservoir 144. The reservoir 144 can be in fluid connection with a liquid transport element 136. The liquid transport element 136 can transport the aerosol precursor composition stored in the reservoir 144 via capillary action to the heating element 134 that is in the form of a metal wire coil in this embodiment. As such, the heating element 134 is in a heating arrangement with the liquid transport element 136.

In use, when a user draws on the article 100, airflow is detected by the sensor 108, the heating element 134 is activated, and the components for the aerosol precursor composition are vaporized by the heating element 134. Drawing upon the mouthend of the article 100 causes ambient air to enter the air intake 118 and pass through the cavity 125 in the coupler 124 and the central opening in the projection 141 of the base 140. In the cartridge 104, the drawn air combines with the formed vapor to form an aerosol. The aerosol is whisked, aspirated, or otherwise drawn away from the heating element 134 and out the mouth opening 128 in the mouthend of the article 100.

An input element may be included with the aerosol delivery device. The input may be included to allow a user to control functions of the device and/or for output of information to a user. Any component or combination of components may be utilized as an input for controlling the function of the device. For example, one or more pushbuttons may be used as described in U.S. Pub. No. 2015/0245658 to Worm et al., which is incorporated herein by reference. Likewise, a touchscreen may be used as described in U.S. Pat. Pub. No. 2016/0262454 to Sears et al., which is incorporated herein by reference. As a further example, components adapted for gesture recognition based on specified movements of the aerosol delivery device may be used as an input. See U.S. Pub. 2016/0158782 to Henry et al., which is incorporated herein by reference.

In some embodiments, an input may comprise a computer or computing device, such as a smartphone or tablet. In particular, the aerosol delivery device may be wired to the computer or other device, such as via use of a USB cord or similar protocol. The aerosol delivery device also may communicate with a computer or other device acting as an input via wireless communication. See, for example, the systems and methods for controlling a device via a read request as described in U.S. Pub. No. 2016/0007561 to Ampolini et al., the disclosure of which is incorporated herein by reference. In such embodiments, an APP or other computer program may be used in connection with a computer or other computing device to input control instructions to the aerosol delivery device, such control instructions including, for example, the ability to form an aerosol of specific composition by choosing the nicotine content and/or content of further flavors to be included.

The various components of an aerosol delivery device according to the present disclosure can be chosen from components described in the art and commercially available. Examples of batteries that can be used according to the disclosure are described in U.S. Pat. Pub. No. 2010/0028766 to Peckerar et al., the disclosure of which is incorporated herein by reference in its entirety.

The aerosol delivery device can incorporate a sensor or detector for control of supply of electric power to the heat generation element when aerosol generation is desired (e.g., upon draw during use). As such, for example, there is provided a manner or method for turning off the power supply to the heat generation element when the aerosol delivery device is not be drawn upon during use, and for turning on the power supply to actuate or trigger the generation of heat by the heat generation element during draw. Additional representative types of sensing or detection mechanisms, structure and configuration thereof, components thereof, and general methods of operation thereof, are described in U.S. Pat. No. 5,261,424 to Sprinkel, Jr.; U.S. Pat. No. 5,372,148 to McCafferty et al.; and PCT WO 2010/003480 to Flick; which are incorporated herein by reference.

The aerosol delivery device most preferably incorporates a control mechanism for controlling the amount of electric power to the heat generation element during draw. Representative types of electronic components, structure and configuration thereof, features thereof, and general methods of operation thereof, are described in U.S. Pat. No. 4,735,217 to Gerth et al.; U.S. Pat. No. 4,947,874 to Brooks et al.; U.S. Pat. No. 5,372,148 to McCafferty et al.; U.S. Pat. No. 6,040,560 to Fleischhauer et al.; U.S. Pat. No. 7,040,314 to Nguyen et al. and U.S. Pat. No. 8,205,622 to Pan; U.S. Pat. Pub. Nos. 2009/0230117 to Fernando et al., 2014/0060554 to Collet et al., and 2014/0270727 to Ampolini et al.; and U.S. Pub. No. 2015/0257445 to Henry et al.; which are incorporated herein by reference.

Representative types of substrates, reservoirs or other components for supporting the aerosol precursor are described in U.S. Pat. No. 8,528,569 to Newton; U.S. Pat. Pub. Nos. 2014/0261487 to Chapman et al. and 2014/0059780 to Davis et al.; and U.S. Pub. No. 2015/0216232 to Bless et al.; which are incorporated herein by reference. Additionally, various wicking materials, and the configuration and operation of those wicking materials within certain types of electronic cigarettes, are set forth in U.S. Pat. No. 8,910,640 to Sears et al.; which is incorporated herein by reference.

For aerosol delivery systems that are characterized as electronic cigarettes, the aerosol precursor composition most preferably incorporates tobacco or components derived from tobacco. In one regard, the tobacco may be provided as parts or pieces of tobacco, such as finely ground, milled or powdered tobacco lamina. In another regard, the tobacco may be provided in the form of an extract, such as a spray dried extract that incorporates many of the water soluble components of tobacco. Alternatively, tobacco extracts may have the form of relatively high nicotine content extracts, which extracts also incorporate minor amounts of other extracted components derived from tobacco. In another regard, components derived from tobacco may be provided in a relatively pure form, such as certain flavoring agents that are derived from tobacco. In one regard, a component that is derived from tobacco, and that may be employed in a highly purified or essentially pure form, is nicotine (e.g., pharmaceutical grade nicotine).

The aerosol precursor composition, also referred to as a vapor precursor composition, may comprise a variety of components including, by way of example, a polyhydric alcohol (e.g., glycerin, propylene glycol, or a mixture thereof), nicotine, tobacco, tobacco extract, and/or flavorants. Representative types of aerosol precursor components and formulations also are set forth and characterized in U.S. Pat. No. 7,217,320 to Robinson et al. and U.S. Pat. Pub. Nos. 2013/0008457 to Zheng et al.; 2013/0213417 to Chong et al.; 2014/0060554 to Collett et al.; 2015/0020823 to Lipowicz et al.; and 2015/0020830 to Koller, as well as WO 2014/182736 to Bowen et al, the disclosures of which are incorporated herein by reference. Other aerosol precursors that may be employed include the aerosol precursors that have been incorporated in the VUSE® product by R. J. Reynolds Vapor Company, the BLU™ product by Lorillard Technologies, the MISTIC MENTHOL product by Mistic Ecigs, and the VYPE product by CN Creative Ltd. Also desirable are the so-called "smoke juices" for electronic cigarettes that have been available from Johnson Creek Enterprises LLC.

The amount of aerosol precursor that is incorporated within the aerosol delivery system is such that the aerosol generating piece provides acceptable sensory and desirable performance characteristics. For example, it is highly preferred that sufficient amounts of aerosol forming material (e.g., glycerin and/or propylene glycol), be employed in order to provide for the generation of a visible mainstream aerosol that in many regards resembles the appearance of tobacco smoke. The amount of aerosol precursor within the aerosol generating system may be dependent upon factors such as the number of puffs desired per aerosol generating piece. Typically, the amount of aerosol precursor incorporated within the aerosol delivery system, and particularly within the aerosol generating piece, is less than about 2 g, generally less than about 1.5 g, often less than about 1 g and frequently less than about 0.5 g.

Yet other features, controls or components that can be incorporated into aerosol delivery systems of the present disclosure are described in U.S. Pat. No. 5,967,148 to Harris et al.; U.S. Pat. No. 5,934,289 to Watkins et al.; U.S. Pat. No. 5,954,979 to Counts et al.; U.S. Pat. No. 6,040,560 to Fleischhauer et al.; U.S. Pat. No. 8,365,742 to Hon; U.S. Pat. No. 8,402,976 to Fernando et al.; U.S. Pat. Pub. Nos. 2010/0163063 to Fernando et al.; 2013/0192623 to Tucker et al.; 2013/0298905 to Leven et al.; 2013/0180553 to Kim et al., 2014/0000638 to Sebastian et al., 2014/0261495 to Novak et al., and 2014/0261408 to DePiano et al.; which are incorporated herein by reference.

The foregoing description of use of the article can be applied to the various embodiments described herein through minor modifications, which can be apparent to the person of skill in the art in light of the further disclosure provided herein. The above description of use, however, is not intended to limit the use of the article but is provided to comply with all necessary requirements of disclosure of the present disclosure. Any of the elements shown in the article illustrated in FIG. 1 or as otherwise described above may be included in an aerosol delivery device according to the present disclosure.

In one or more embodiments, the present disclosure particularly can relate to fibrous substrates that are configured for use in an aerosol delivery device. The substrates can be formed from a specific type of fiber or fibers that imparts desirable properties in relation to one or both of absorbency and wicking ability. The substrates can be configured for use in or as a reservoir. For example, a substrate according to the present disclosure can be substantially in the form of a nonwoven mat that can substantially formed into the shape of a tube encircling the interior of the shell of the aerosol delivery device. As a further example, a substrate as described herein can be provided within a separate reservoir container. Suitable reservoir containers are described, for example, in U.S. Pub. No. 2015/0144145 to Chang et al., the disclosure of which is incorporated herein by reference. The substrates likewise can be configured for use as a liquid transport element. For example, a substrate according to the present disclosure can have at least two separate ends, portions, or surfaces, one of which is in fluid communication with an aerosol precursor composition in a reservoir, and the other of which is directly in a heating arrangement with a heater (e.g., being in direct contact with, for example, a wire heating coil, or being in a radiant heating relationship with a radiant heat source).

As non-limiting examples, each of the following embodiments is encompassed by the present disclosure. Referencing FIG. 2, a substrate 210 as described herein can be in the form of an elongated wick having a first end 211 that is in fluid communication with an aerosol precursor composition 218 in a reservoir 220 (in the form of a bottle) and a second end 212 that is in a heating arrangement with a heater 230. Referencing FIG. 3, a substrate 310 as described herein can be in the form of an elongated wick having a first end 311, a second end 312, and an intermediate portion 313, one or both of the first end and the second end being in fluid communication with an aerosol precursor composition in a reservoir 320 (in the form of a fibrous mat in a tube shape, shown in cross-section), and the intermediate portion 313 being in a heating arrangement with a heater 330. Referencing FIG. 4, a substrate 410 as described herein can be in the form of a fibrous disc or other cross-sectional shape so as to be substantially a mat having a first surface 411 and an opposing second surface 412, the first surface being in fluid communication with an aerosol precursor composition 418 in a reservoir 420, and the opposing second surface being in a heating arrangement with a heater 430 or being in fluid communication with a wick 440 configured to transport aerosol precursor composition from the substrate to a heater. In further embodiments, the substrate is utilized as a fibrous reservoir. See, for example, FIG. 8.

In one or more embodiments, substrates according to the present disclosure can be formed from fibers made from a variety of materials. For example, suitable fibers can include cellulose acetate, polyethylene terephthalate, cotton, and other natural, manufactured, or synthetic materials suitable for use in forming fibers capable of being formed into a nonwoven substrate. Preferably, at least a portion of the fibers forming the present substrates are made from a regenerated cellulose. As non-limiting examples, a suitable regenerated cellulose can be a viscose fiber prepared from any variety of cellulose-containing materials, such as wood (e.g., *eucalyptus* trees), grasses (e.g., bamboo), cotton, and other plant-based materials.

In addition to the type of material used to form the fibers, substrates as disclosed herein may exhibit desirable properties as least in part due to the physical structure of the fiber. It is common for fibers (particularly extruded fibers) to be solid and have a substantially round cross-section. While fibers of such construction may also be included in the present substrates (e.g., as a blend), it can be particularly useful for the substrates to include fibers having a multi-lobal cross-section. For example, the present substrates may comprise multi-lobal fibers in an amount of about 25% or more, about 50% or more, about 60% or more, about 75% or more, about 90% or more, or about 99% or more by weight based on the total weight of fibers present in the substrate. It is understood that the foregoing values will have an inherent maximum of 100% by weight—i.e., wherein the all fibers used in forming the substrate are multi-lobal fibers. In some embodiments, the multi-lobal fibers may comprise about 25% to about 100%, about 50% to about 100%, or about 90% to about 100% by weight of the substrate, based on the total weight of fibers present in the substrate. It is understood that the terms "multi-lobal fiber" and "fiber having a multi-lobal cross-section" are meant to be interchangeable. In some embodiments, a multi-lobal fiber can be a fiber that, in cross-section, includes a common base or hub (typically at about a central portion of the cross-section of the fiber) with at least three lobes or spokes extending therefrom. A multi-lobal fiber may further be defined as a fiber having three or more extensions such that at least one set of adjacent extensions form an angle of less than 180 degrees and thereby define one or more channels extending longitudinally along the fiber. Non-limiting examples of multi-lobal fibers are shown in FIG. 5A through FIG. 5D.

As seen in FIG. 5A, a multi-lobal fiber 500 includes a plurality of lobes 505 extending from a central hub 510, adjacent lobes having an angle $\alpha$ that is less than 180 degrees so as to form a channel 515 between the adjacent lobes. The lobes of a multi-lobal fiber can have a variety of shapes. As seen in FIG. 5B, the multi-lobal fiber 500 includes a plurality of lobes 505 that are substantially rounded while still forming a plurality of channels 515 between adjacent lobes. As yet a further example, as seen in FIG. 5C, a multi-lobal fiber 500 can have a cross-section that is substantially elongated so as to allow for a greater number of lobes 505 and thus a greater number of channels 515 between the adjacent lobes. The number of lobes can vary and can be for example, 3 to 30, 3 to 20, or 3 to 10. Likewise, the spacing between lobes and the size of the lobes in the same fiber can vary. The multi-lobal fibers preferably can include surface features that can further improve the liquid handling properties thereof. As seen in FIG. 5D, the multi-lobal fiber 500 includes a plurality of lobes 505 with channels 515 formed between adjacent lobes, and the lobes include outer surfaces 520 that have a plurality of striations 525 that form micro- or nano-channels that can further the liquid retention and/or liquid transfer abilities of the fibers. A specific example of a multi-lobal fiber that is also striated and that can be particularly useful according to the present disclosure is fibers sold under the brand name GALAXY® from Kelheim Fibres.

In some embodiments, substrates according to the present disclosure can be hollow. An exemplary hollow fiber 600 is shown in FIG. 6, the fiber having an outer wall 602 that is preferably thin relative to the overall diameter of the fiber (e.g., the wall thickness being about 1% to about 20%, about 2% to about 15%, or about 3% to about 10% of the fiber diameter) and having a hollow interior cavity 604. In some embodiments, a hollow fiber may also be segmented. Hollow fibers can be particularly beneficial in that the individual fibers may substantially flatten in a dry state and can swell to accept a liquid as the liquid is absorbed by the substrate formed by the hollow fibers. A specific example of a hollow, segmented fiber that can be particularly useful according to the present disclosure is fibers sold under the brand name BRAMANTE from Kelheim Fibres.

A substrate according to the present disclosure can be formed of a single layer of nonwoven fibers. A layer of fibers can be formed by any suitable method, such as wet-laid methods and dry-laid methods. Preferably, the fibers utilized in forming the substrates are staple fibers. If desired, a binder may be used, such as binders that typically may be used with cellulose acetate. A binder is understood to be a material that imparts a cohesive effect to the fibers used in forming the disclosed reservoirs. For example, the binder can be a material that partially solubilizes the fibers such that the fibers bind to each other or to further fibrous materials included in the non-woven reservoir. Exemplary binders that can be used include polyvinyl acetate (PVA) binders, starch, and triacetin. In some embodiments, cohesiveness may be provided through alternate means, such as through needle punching or other mechanical processes for intertwining the fibers (e.g., hydro-entanglement). A substrate thus can be defined by the actual physical structure of being a needle-punched substrate in that the fibers are intertwined in a manner that would not be present prior to undertaking a needle-punching step. As such, the term "needle-punched" is understood to reference a physical state of the substrate and not a process. Likewise, the term "hydro-entangled" is understood to reference a physical state of the substrate and not a process. In other words, while hydro-entangling is a process whereby the substrate may be modified, a hydro-entangled substrate is a material that is defined at least in part by the intertwining of fibers that would not be present prior to undertaking a hydro-entangling step.

In one or more embodiments, a substrate as described herein can comprise a plurality of layers. For example, two or more layers having the same composition can be combined. Alternatively, two or more layers of differing compositions may be combined.

A combination of multiple layers may be configured to promote movement of liquid in a first direction (e.g., on a side facing a first substrate layer) and to restrict movement of liquid in a second direction (e.g., on a side facing a second substrate layer). This is illustrated in FIG. 7, where a substrate 700 is formed of a first layer 760 and a second layer 770. The first substrate layer 760 is formed from fibers having high absorbency and configured for release of an absorbed liquid via a wicking action. The second substrate layer 770 is formed from fibers having low absorbency and configured to resist, reduce, or prevent movement of liquid therethrough. As seen in FIG. 7, an aerosol precursor composition absorbed into the first substrate layer 760 will move free away from the first substrate layer (illustrated by the bold arrows), and the aerosol precursor composition is substantially prevented from passage through the second substrate layer 770 (as shown by the absence of bold arrows). As such, further elements of an aerosol delivery device on the side of the substrate 700 comprising the first substrate layer 760 can freely receive the aerosol precursor composition absorbed in to the first substrate layer so that the liquid can be vaporized, and further elements of an aerosol delivery device on the side of the substrate comprising the second substrate layer 770 can remain substantially free of contact with any aerosol precursor composition. As illustrated, the first substrate layer 760 is thicker than the second substrate layer 770; however, the two substrate layers may be substantially the same thickness or the second substrate layer can be thicker than the first substrate layer. Further, in some embodiments, it can be useful to include a third substrate layer 780 between the first substrate layer 760 and the second substrate layer 770. The third substrate layer is optional, and it may include a material useful for bonding the first substrate layer to the second substrate layer. Alternatively, the third substrate layer may be a mechanical separating layer so that the first substrate layer is not in direct contact with the second substrate layer, and passage of liquid between the first and second substrate layers can be further reduced or prevented. Bonding between the first substrate layer and the second substrate layer also can be achieved by needle punching, hydro-entangling, or like methods in addition to or in place of the use of a third substrate layer. Further, low melting binding fibers may be included in one or both of the first substrate layer and the second substrate layer to independently bond the fibers making up the separate substrate layers and/or to bond the first substrate layer to the second substrate layer. Any type of low melting binder fibers can be used for this purpose.

The second substrate layer can be formed from fibers that are hydrophobic. In some embodiments, hydrophobicity can be provided via an additive that can be added to the fibers before fiber formation (i.e., combined with the fiber forming material) or after fiber formation. For example, the fibers may be coated with one or more hydrophobic coating materials that can be added to the fibers after formation and/or can be added to the substrate made with the fibers. In some embodiments, hydrophobic fibers can be formed by adding a water repelling material during formation of the fibers. For example, long chain hydrocarbons can be covalently bonded to the cellulosic material used to form the fibers prior to fiber formation. As such, the finally formed fibers can exhibit an intrinsic hydrophobicity. An example of a hydrophobic fibers useful according to the present disclosure is sold under the name OLEA by Kelheim Fibres.

If desired, the second substrate layer can be substantially non-fibrous. For example, a polymeric film that is substantially impermeable to aqueous liquids can be utilized.

An exemplary cartridge 804 for an aerosol delivery device 804 is shown in FIG. 8, and it is understood that the cartridge can be configured for attachment to a further body configured to provide power and control functions, such as a control body 102 as shown in FIG. 1. The cartridge 804 includes a housing 803 (or shell) and a reservoir 810 formed of a substrate material as described herein positioned within the housing. The reservoir 810 is formed of a first substrate layer 810*a* and a second substrate layer 810*b*. The first substrate layer 810*a* is formed of fibers configured to provide high absorbency and free release of liquid absorbed therein to a wicking material, such as the liquid transport element 840 that has the heater 840 coiled therearound. The second substrate layer 810*b* is formed of fibers configured to be substantially hydrophobic and thus have very low or no transfer of liquid in the first substrate layer 810*a*. An annular gap 881 is present between the reservoir 810 and the housing 803, although it is understood that the reservoir may be in direct contact with the inner surface of the housing. The dual layer substrate is thus beneficial in that the aerosol precursor liquid stored in the first substrate layer 810*a* is readily wicked to the heater 840 via the liquid transport element 830; however, the aerosol precursor liquid is substantially prevented from passing to the annular gap 881 where the liquid may move throughout the cartridge and potentially leak from the cartridge housing 803 and/or make its way into a control body where it can potentially foul the battery and/or the controller.

In some embodiments, the substrate according to the present disclosure can be defined in relation to its basis weight. Preferably, a substrate as described herein can exhibit a loading capacity that is greater than the loading capacity of other fibrous materials having the same basis weight. For example, a substrate according to the present disclosure can have a basis weight of about 100 grams per square meter (GSM) to about 250 gsm, about 110 gsm to about 230 gsm, or about 120 gsm to about 220 gsm.

Percent loading capacity can be calculated based upon an initial dry weight of a substrate sample and the weight of the substrate sample when saturated with a test liquid. Percent loading capacity thus can be calculated according to the following formula.

$$\text{Percent loading capacity} = \frac{(\text{final saturated weight} - \text{initial dry weight})}{\text{initial dry weight}} \times 100$$

In some embodiments, a substrate according to the present disclosure can have a loading capacity of about 1500% or greater, about 2000% or greater, or about 2500% or greater as calculated according to the above formula. In particular, a substrate as described herein can have a loading capacity of about 1500% to about 5000%, about 1700% to about 4700%, about 2000% to about 4500%, or about 2500% to about 4000% as calculated according to the above formula.

EXAMPLE 1

Absorbency

Multiple substrates were prepared as a single layer substrate or a multi-layer substrate in order to evaluate the absorbency of the substrate. Three different fiber types were used to form the samples: BRAMANTE hollow, segmented fibers (3.3 dtex×40 mm) having a substantially round or oval cross-section (designated "B" hereafter); GALAXY® trilobal fibers (3.3 dtex×30 mm) with striations (designated "G" hereafter); and OLEA hydrophobic fibers (1.7 dtex×30 mm) having a long chain hydrocarbon covalently cross-linked to the fiber-forming material (designated "O" hereafter). All three fiber types are formed from regenerated cellulose. Single layer substrates were formed from staple fibers of the three fiber types, each substrate being formed from only a single fiber type—i.e., 100% by weight B fibers, 100% by weight G fibers, or 100% by weight O fibers. Control and comparative samples were prepared using plain cellulose acetate. All substrates were formed using a dry-laid process. For all single layer samples, 80 grams of fiber was weighed out for each sample. The fiber was passed through a card three times to ensure acceptable opening and uniformity of the finished web. For the two layer samples, 40 grams of fiber was used to make a web for each layer. The fiber again was passed through the card three times for uniformity and dispersion. The layers were then stacked upon each other for needling or layered with an adhesive web for glue bonding. For the three layer samples, 26.5 grams of each fiber was weighed, and the same procedures as the one and two layer samples were followed. Needling was performed on a Felt Loom laboratory needler. Each sample was passed through the needler four times (twice on each side). The needle loom speed and punches per inch (ppi) were both set at 50%. The needles used were six barbs per needle. The "glued" samples were adhered with a light weight polyethylene adhesive web (e.g., Bostik PO104 hot melt web adhesive). The samples were layered with the adhesive web and placed in a hot press for 30 seconds at 240° F. The substrate samples were tested against a plain cellulose acetate substrate, a plain cellulose acetate substrate that was needled, and an organic cotton substrate. Fifteen inventive samples of substrates according to the present disclosure were evaluated, and the composition of each substrate is shown below in TABLE 1 along with the composition of the control and comparative samples.

| Sample ID | Composition (basis weight) |
|---|---|
| IS1 | Single layer - needle-punched B fibers (153 gsm) |
| IS2 | Single layer - needle-punched O fibers (156 gsm) |
| IS3 | Single layer - needle-punched G fibers (140 gsm) |
| IS4 | Two layers needle punched together - 1) G fibers; 2) B fibers (140 gsm) |

-continued

| Sample ID | Composition (basis weight) |
|---|---|
| IS5 | Two layers needle punched together - 1) O fibers; 2) B fibers (165 gsm) |
| IS6 | Two layers needle punched together - 1) G fibers; 2) O fibers (136 gsm) |
| IS7 | Two layers glued together - 1) G fibers; 2) O fibers (145 gsm) |
| IS8 | Two layers glued together - 1) G fibers; 2) B fibers (156 gsm) |
| IS9 | Two layers glued together - 1) O fibers; 2) B fibers (163 gsm) |
| IS10 | Three layers glued together - 1) B fibers; 2) O fibers; 3) G fibers (192 gsm) |
| IS11 | Three layers glued together - 1) B fibers; 2) G fibers; 3) O fibers (196 gsm) |
| IS12 | Three layers glued together - 1) O fibers; 2) B fibers; 3) G fibers (200 gsm) |
| IS13 | Three layers needle-punched together - 1) B fibers; 2) G fibers; 3) O fibers (178 gsm) |
| IS14 | Three layers needle-punched together - 1) B fibers; 2) O fibers; 3) G fibers (162 gsm) |
| IS15 | Three layers needle-punched together - 1) O fibers; 2) B fibers; 3) G fibers (153 gsm) |
| CON1 | Single layer of cellulose acetate |
| COMP1 | Single layer of needle-punched cellulose acetate |
| COMP2 | Single layer of organic cotton |

An e-liquid composition was applied to each of the test samples. The e-liquid was formed of glycerin, propylene glycol, water, and flavorant. The e-liquid was added slowly to the test sample until a saturation point was reached, and the sample would not hold further liquid. The mass of liquid added to the sample was used to calculate percent loading capacity, and the resultant percent loading capacity for each sample is shown in FIG. 9. As seen therein, all of the inventive sample substrates exhibited higher percent loading capacity than the control cellulose acetate (CON1), the needle-punched cellulose acetate (COMP1), and the organic cotton (COMP2).

The relative increase in loading capacity was also calculated in comparison to the cellulose acetate control sample. The results are shown in FIG. 10. As seen therein, the inventive sample substrates exhibited a relative increase in loading capacity of as much as 2.15 times compared to the cellulose acetate control. Relative loading capacity versus the cellulose acetate (CA) control was calculated according to the following formula.

$$\text{Relative loading capacity versus } CA = \frac{(\%\text{ wt. gain of sample} - \%\text{ wt. gain of } CA)}{\%\text{ wt. gain of } CA} \times 100$$

EXAMPLE 2

Aerosol Formation

The ability of a substrate to release an aerosol precursor composition for aerosol formation was evaluated by using each of the samples from Example 1 in a test device. The testing was carried out using a cartridge with a construction similar to the cartridge 104 shown in FIG. 1. Each test sample was provided with uniform dimensions and was used as the reservoir 144 shown in FIG. 1. Puff simulation was carried out utilizing a commercially available puff simulation apparatus—i.e., a cigarette smoking machine. Puff simulation was carried out with a three second puff (55 $cm^3$ volume) with 30 second intervals between puffs. The puff group midpoint was used as the average. In particular, a mass measurement was taken at puff 0, and then 20 separate puffs were collected for the respective reservoir substrate material, the puffs being collected on a Cambridge filter pad commonly used for the collection of total particulate matter (TPM) in cigarette smoke. The total mass generated was divided by 20 to obtain the mass per puff. For plotting purposes, the average mass per puff at the puff group midpoint was used (i.e., the mass at puff 10).

The results of the test are shown in FIG. 11 and FIG. 12, wherein aerosol production is shown for each sample on the basis of TPM per puff on the test device including the respective substrate. To confirm whether the multi-layer substrates were facilitating liquid saturation on one face of the substrate versus the other, the multi-layer substrate samples were oriented in both directions for testing. In the legends for FIG. 11 and FIG. 12, the fiber designation followed by the word "in" indicates which substrate layer was oriented inward toward the wick and heater. The number for each substrate in the legend again relates to the basis weight of the substrate. For the multi-layer substrates, presence of the word "glue" in the legend indicates that the layers were glued together. In all other samples, needle punching was used.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device comprising:

a housing;

a substrate at least partially formed from regenerated cellulose fibers;

an aerosol forming liquid retained by the substrate; and a heater operatively arranged for vaporization of the aerosol forming liquid;

wherein the substrate comprises a plurality of layers including a first layer and a second layer;

wherein the plurality of layers is configured to promote movement of liquid in a first direction and to restrict movement of liquid in a second direction;

wherein the first layer is configured for storage and release of the aerosol precursor composition and comprises one or more of regenerated cellulose fibers having a hollow, substantially cylindrical cross-section and regenerated cellulose fibers having a multi-lobal cross-section; and wherein the second layer is hydrophobic and comprises regenerated cellulose fibers that include a hydrophobic additive.

2. The aerosol delivery device of claim 1, wherein the regenerated cellulose fibers have a multi-lobal cross-section and include striations extending longitudinally along surfaces of one or more lobes of the fibers.

3. The aerosol delivery device of claim 1, wherein the substrate is a non-woven.

4. The aerosol delivery device of claim 1, wherein the plurality of layers are needle-punched.

5. The aerosol delivery device of claim 1, wherein the plurality of layers are adhered together.

6. The aerosol delivery device of claim 1, wherein the substrate forms at least a portion of a reservoir.

7. The aerosol delivery device of claim 6, further comprising a liquid transport element in fluid connection with the reservoir and in fluid connection with the heater.

8. The aerosol delivery device of claim 1, wherein the substrate forms at least part of a liquid transport element that is in fluid connection with a reservoir and in fluid connection with the heater.

9. The aerosol delivery device of claim 1, wherein the substrate is in direct contact with the heater.

10. The aerosol delivery device of claim 1, wherein the substrate has a loading capacity for the aerosol precursor composition of at least 2000% relative to an initial dry weight of the substrate.

11. The aerosol delivery device of claim 1, wherein the substrate has a basis weight of about 100 gsm to about 250 gsm.

12. The aerosol delivery device of claim 1, wherein the aerosol delivery device further comprises a power source and a controller.

13. A method of preparing an aerosol delivery device, the method comprising:

providing a housing;

placing within the housing a substrate, wherein the substrate comprises a plurality of layers including a first layer and a second layer, wherein the plurality of layers is configured to promote movement of liquid in a first direction and to restrict movement of liquid in a second direction; wherein the first layer is configured for storage and release of the aerosol precursor composition and comprises one or more of regenerated cellulose fibers having a hollow, substantially cylindrical cross-section and regenerated cellulose fibers having a multi-lobal cross-section; and wherein the second layer is hydrophobic and comprises regenerated cellulose fibers that include a hydrophobic additive; and configuring the substrate to be in fluid communication with a heater within the housing;

wherein, before or after placing the substrate within the housing, an aerosol forming liquid is retained by the substrate.

14. The method of claim 13, further comprising combining a mouthpiece with the housing.

15. The method of claim 13, further comprising combining the housing with a second housing that includes a battery and a controller.

* * * * *